United States Patent [19]

Müller et al.

[11] 4,241,563

[45] Dec. 30, 1980

[54] APPARATUS FOR PRODUCING AND FILLING TUBULAR BAGS

[75] Inventors: Werner Müller, Neuhausen am Rheinfall; Hans Heinzer, Beringen, both of Switzerland

[73] Assignee: SIG Schweizerische Industrie-Gesellschaft, Neuhausen am Rheinfall, Switzerland

[21] Appl. No.: 70,921

[22] Filed: Aug. 30, 1979

[30] Foreign Application Priority Data

Sep. 29, 1978 [CH] Switzerland ..... 10152/78

[51] Int. Cl.[3] ..... B65B 31/04; B65B 9/08

[52] U.S. Cl. ..... 53/511; 53/552

[58] Field of Search ..... 53/511, 512, 551, 552, 53/554; 141/47, 48, 50, 52, 60

[56] References Cited

U.S. PATENT DOCUMENTS 3,318,067 5/1967 Grafingholt ..... 53/511

3,482,373 12/1969 Morris ..... 53/511

*Primary Examiner*—Travis S. McGehee

*Attorney, Agent, or Firm*—Spencer & Kaye

[57] ABSTRACT

A heat-sealable foil is shaped around a shaping pipe to form a tube and during removal from the shaping pipe is provided with transverse seams by means of transverse heating jaws. The resulting bags are filled by means of a fill pipe and a dosaging worm or auger. A conduit leads from the lower end of the shaping pipe to a bellows and to a bottle of protective gas. The bellows forms a closed chamber whose volume is periodically increased and reduced in the operating rhythm of the bag forming apparatus by means of drive members. Thus the pressure conditions at the end of the shaping pipe can be influenced periodically, so as to avoid that the filled or sealed bags contain undesirable air inclusions or, when filling under protective gas, so as to avoid greater losses of protective gas from leaking into the open air.

5 Claims, 3 Drawing Figures

APPARATUS FOR PRODUCING AND FILLING TUBULAR BAGS

BACKGROUND OF THE INVENTION

The present invention relates to an apparatus for producing and filling tubular bags formed from heat sealable foils.

Various embodiments of apparatus for producing filled tubular bags are known. All such known apparatus harbor the danger that during sealing of a filled bag, the upper portion of the resulting package will be tightly filled with air. It has therefore already been proposed to extract the air from the bags before the upper transverse seal is made. If this is done by means of a continuously operating blower, the drawback arises that the subatmospheric pressure produced increases the friction between the tube from which the bag is formed and the shaping pipe so that removal of the tube is made more difficult.

Swiss Pat. No. 554,258 issued July 26th, 1973, discloses the extraction of a protective gas from the end of the shaping pipe by means of a blower and the reintroduction of this gas into the dosaging device at the upper end of the fill pipe. However, the above-mentioned drawback again arises as a result of the continuously operating blower. Moreover, there exists the danger, when goods are handled which tend to form dust, that a certain quantity of the goods is carried along with the gas and must then be separated by means of a filter so as to prevent soiling of the blower and of the dosaging scales.

SUMMARY OF THE INVENTION

It is an object of the present invention to provide an apparatus of the above-mentioned type which prevents the creation of tightly filled packages and in which only slight friction occurs during removal of the foil tube.

This is accomplished according to the present invention in that in an apparatus for producing and filling tubular bags formed of a heat-sealable foil including a shaping pipe about which the foil is wrapped to form a tube, longitudinal heating means adjacent the shaping pipe for producing a longitudinal seam in the tube, removal means, including transverse heating jaws for periodically producing transverse seams in the tube, for periodically removing a portion of the tube from one end of the shaping pipe to form a bag, filling means, disposed within the shaping pipe, for dispensing the material with which the bags are to be filled into the removed portion of the tube, and means for influencing the pressure in the interior of the portion of said tube being filled, with the means for influencing being connected via a conduit with the area of the one end of said shaping pipe; the means for influencing the pressure comprises a chamber whose volume is variable, and drive means are provided for periodically varying the volume of the chamber in the operating rhythm of the removal means.

The chamber whose volume is periodically changed in the operating rhythm of the apparatus may advisably be a bellows with flexible walls.

With such a chamber it is possible to regulate the pressure conditions in the bag and at the end of the fill pipe so that optimum conditions exist during every phase of the process. Shortly before a filled bag is sealed, the pressure may be lowered, for example, in order to remove air from the bag. After sealing of the bag, the pressure is increased which facilitates removal of the bag from the fill pipe.

The design according to the present invention is particularly suitable when the bags are filled in a protective gas atmosphere so as to keep the oxygen in the air away from the filled bags. Since the protective gas is supplied continuously, increases in pressure in the fill pipe, and thus greater losses of gas, can be avoided in that an essentially constant internal pressure is maintained continuously at the end of the fill pipe.

DETAILED DESCRIPTION OF THE PREFERRED EMBODIMENTS

Figure 1:
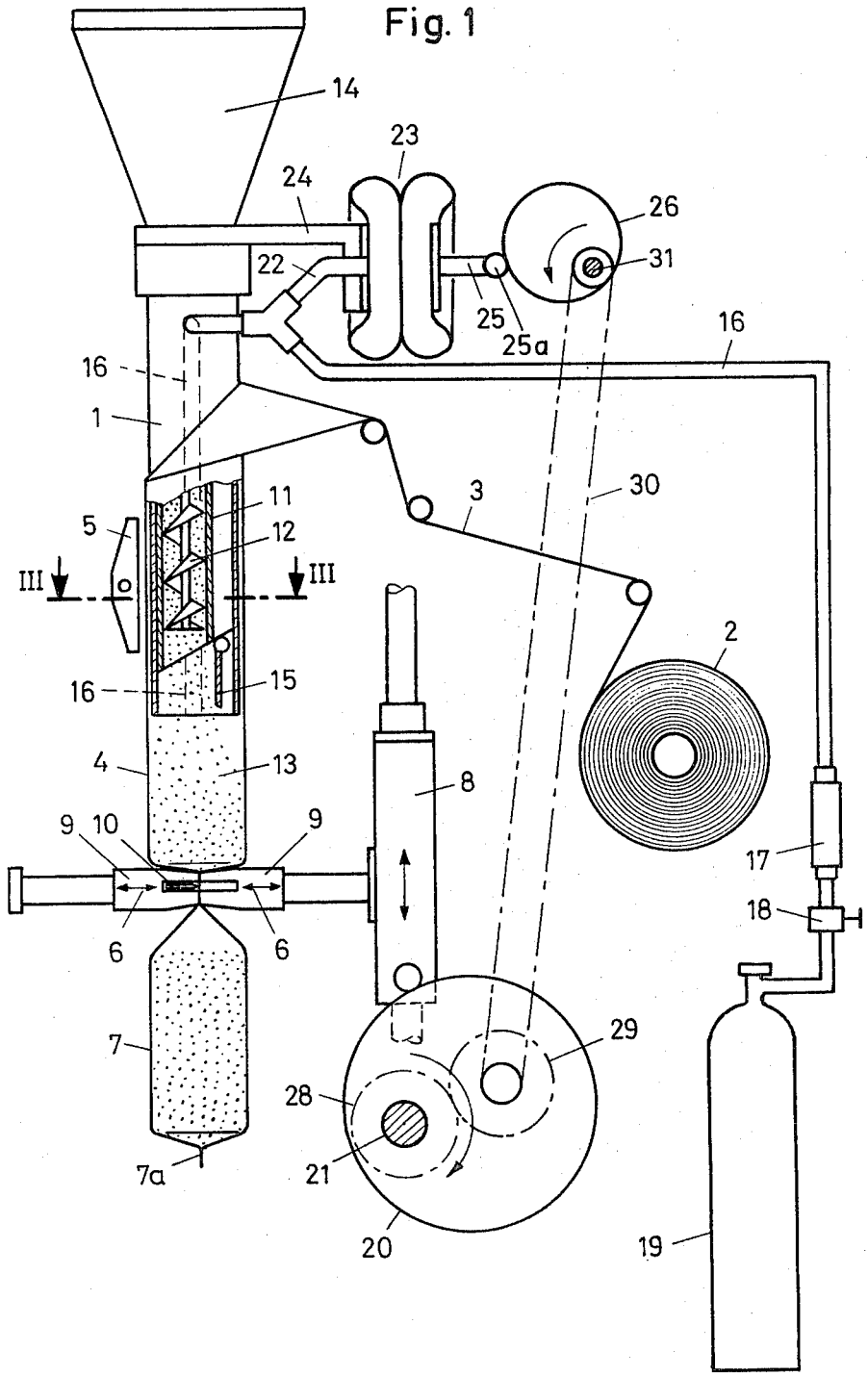
FIG. 1 is a schematic side view of the apparatus according to the present invention.

Referring now to FIG. 1, the apparatus includes, in a known manner, a shaping pipe 1 of rectangular cross section around which a heat-sealable foil 3 withdrawn from a supply roll 2 is shaped into a hose or tube 4. A longitudinal seam 4*a* (FIG. 3) is formed in hose 4 by a longitudinal heating jaw 5. Below the shaping pipe 1, on a carriage 8 which can be moved up and down, there are disposed transverse heating jaws 9 which are moved in the direction of the double arrows 6 and serve to form the transverse seams 7*a* of the bags. By means of blades 10 built into the transverse heating jaws 9, the transverse seams 7*a* are cut and thus individual, filled bags 7 are separated.

Figure 3:
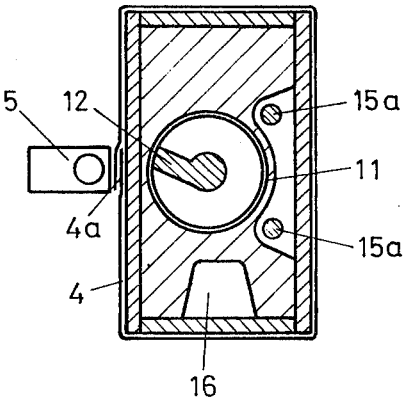
FIG. 3 is a sectional view along line III—III of FIG. 1 to a larger scale.

The fill pipe 11 with its dosaging worm or auger 12 is disposed in the interior of the shaping pipe 1 to feed the fill material 13 from a funnel 14 to the hose or tube 4. A closing flap 15 disposed adjacent the lower end of the fill tube 11 is periodically closed to prevent more fill material 13 from flowing once the proper quantity has been measured out. The closing flap 15 is controlled by actuating rods 15*a* (FIG. 3).

The shaping pipe 1 is also provided with a conduit 16 which extends in the interior of the shaping pipe 1 to its lower end. The conduit 16 serves to supply a protective gas, e.g., nitrogen, and is connected for this purpose, via a flowthrough quantity measuring device 17 and a regulating valve 18, with a bottle of protective gas 19.

The drive of the carriage 8 with the transverse heating jaws 9, which also act as a means for removing the tube or hose 4 from the shaping pipe 1, is shown only schematically. In general, the carriage 8 is moved up and down by an eccentric disc 20 which is fastened on a driven shaft 21.

The above-described configuration of the apparatus is generally known.

Figure 2:
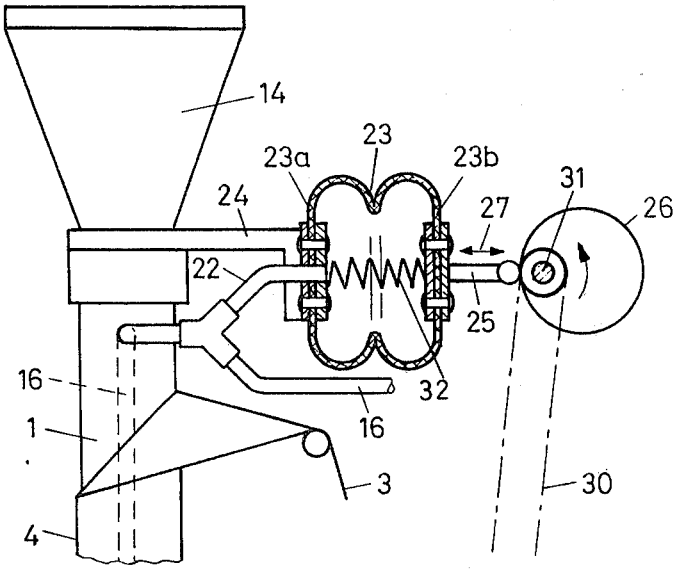
FIG. 2 is a partial view of the apparatus of FIG. 1 showing the bellows in section.

In order to influence the pressure of the protective gas or, if filling is accomplished without such protective gas, of the air at the lower end of the shaping pipe 1, the conduit 16 is connected with a further conduit 22 in the vicinity of its opening into the shaping pipe 1. This conduit 22 is connected to a bellows 23 which forms a closed chamber of variable volume. As can best be seen in FIG. 2, the one side wall 23*a* of the bellows is rigidly connected with a holder or bracket 24 while the oppositely disposed side wall 23*b* is connected with a plunger 25 having a roller 25*a* on the end there of which rides on the circumference of an eccentric or cam 26 mounted on a shaft 31. Consequently, the plunger 25 will be moved back and forth by the eccentric 26 in the direction shown by the double arrow 27. The eccentric 26 is driven mechanically by the drive shaft 21 of the apparatus. On this shaft 21 there is seated a toothed wheel 28 which, via a further toothed wheel 29, drives a chain 30 which in turn drives the shaft 31 and the eccentric disc or cam 26 (FIG. 1). A spring 32 in the interior of the bellows 23 insures that the plunger 25 always contacts the eccentric 26. The bellows 23 advisably is made of plastic with woven inserts, e.g., of Neoprene rubber with a Nylcord insert.

The apparatus operates as follows: during operation without protective gas, i.e., with valve 18 closed, the periodic change of volume of the bellows 23 causes air to be extracted or added at the lower end of the shaping pipe 1. The drive of the eccentric 26 is now so adjusted that, shortly before and during the sealing of a filled bag 7 by the jaws 9, air is extracted by increasing the volume of the bellows 23. Thus the formation of tightly filled bags 7 is prevented. During the downward movement of the carriage 8, i.e., during removal of the hose 4 from the shaping pipe 1, air is introduced by reducing the volume of the bellows 23. This air then escapes between the hose 4 and the exterior of the shaping pipe 1, so that the friction between hose 4 and shaping pipe 1 is reduced and removal is made easier.

During operation with protective gas, i.e., with valve 18 open, the resulting effect is different. Since now protective gas continuously flows from the bottle 19 and is added to the lower end of the shaping pipe 1, pressure fluctuations occur at that point. The pressure increases when the transverse heating jaws 9 form a transverse seam 7*a* and the pressure drops when the jaws 9, as a result of movement of the carriage 8, pull the hose or tube 4 downwardly since the newly formed bag 7 can then receive the gas. In the periods of increased pressure, the protective gas escapes into the ambient air between hose 4 and shaping pipe 1. In order to prevent such losses of protective gas, the eccentric 26 is driven in such a manner that the bellows 23 reduce the rise in pressure, i.e., receive the protective gas via the pipe 22, until the gas is required again for the next filling step. The bellows 23 can thus be used to maintain an approximatly constant pressure at the end of the shaping tube 1, thus reducing gas losses.

Instead of a bellows it is of course also possible to use some other chamber 23 having a variable volume, e.g., a cylinder with a piston. The drive for chamber 23, which must occur in the operating rhythm of the apparatus, could also be of different design. The protective gas conduit connected with gas bottle 19 could also be connected directly to the chamber 23.

It will be understood that the above description of the present invention is susceptible to various modifications, changes and adaptations, and the same are intended to be comprehended within the meaning and range of equivalents of the appended claims.

What is claimed is:

1. In an apparatus for producing and filling tubular bags formed of a heat-sealable foil including a shaping pipe about which the foil is wrapped to form a tube, longitudinal heating means adjacent said shaping pipe for producing a longitudinal seam in the tube, removal means, including transverse heating jaws for periodically producing transverse seams in the tube, for periodically removing a portion of the tube from one end of said shaping pipe to form a bag; filling means, disposed within said shaping pipe, for dispensing the material with which the bags are to be filled into the removed portion of said tube; and means for influencing the pressure in the interior of the portion of said tube being filled, said means for influencing being connected via a conduit with the area of said one end of said shaping pipe; the improvement wherein: said means for influencing the pressure comprises a chamber whose volume is variable, and drive means for periodically varying the volume of said chamber in the operating rhythm of said removal means.

2. The apparatus defined in claim 1 wherein said drive means for periodically varying the volume of said chamber is mechanically connected with a drive means for said removal means.

3. The apparatus defined in claim 1 wherein said chamber is a bellows having flexible walls.

4. The apparatus defined in claim 1 wherein a source of protective gas connected to said conduit leading into the area of said one end of said shaping pipe.

5. The apparatus defined in claim 1 wherein a source of protective gas is connected to said chamber.

* * * * *